US007153337B2

(12) United States Patent
Takiguchi

(10) Patent No.: US 7,153,337 B2
(45) Date of Patent: Dec. 26, 2006

(54) POROUS METAL STRUCTURE BODY AND METHOD FOR MANUFACTURING THE SAME

(75) Inventor: Hiroshi Takiguchi, Shimotsuga-gun (JP)

(73) Assignee: Nippon Piston Ring Co., Ltd., Saitama-ken (JP)

( * ) Notice: Subject to any disclaimer, the term of this patent is extended or adjusted under 35 U.S.C. 154(b) by 150 days.

(21) Appl. No.: 10/648,307

(22) Filed: Aug. 27, 2003

(65) Prior Publication Data

US 2004/0126265 A1 Jul. 1, 2004

(30) Foreign Application Priority Data

Aug. 29, 2002 (JP) ..... 2002-251622

(51) Int. Cl.
*B22F 3/00* (2006.01)

(52) U.S. Cl. ..... 75/228; 428/550

(58) Field of Classification Search ..... 75/228; 428/550

See application file for complete search history.

(56) References Cited

U.S. PATENT DOCUMENTS 1,969,396 A * 8/1934 Duftschmid ..... 419/6
2,625,452 A * 1/1953 Haller ..... 384/279
2,695,231 A * 11/1954 Causley ..... 419/2
3,313,622 A * 4/1967 Potet ..... 419/2
3,394,445 A * 7/1968 Valyi ..... 29/890.02
4,039,703 A * 8/1977 Kamijo et al. ..... 427/183
4,353,155 A * 10/1982 Hillebrand et al. ..... 419/5
4,588,551 A * 5/1986 Iijima et al. ..... 419/2
4,966,221 A * 10/1990 Takasuga et al. ..... 164/120
5,858,056 A * 1/1999 Fujine et al. ..... 75/236
6,737,016 B1 * 5/2004 Shikata et al. ..... 419/2

FOREIGN PATENT DOCUMENTS

JP 60219436 A 11/1985
JP 63150115 U 10/1988
JP 2000337348 A 12/2000
JP 2001276961 A 10/2001

* cited by examiner

*Primary Examiner*—Ngoclan T. Mai
(74) *Attorney, Agent, or Firm*—Crowell & Moring LLP

(57) ABSTRACT

The object of the invention is to provide a porous metal structure body suitable for reinforcing a light metal alloy member such as an aluminum alloy member. A mixed powder containing a metallic powder is filled in a mold, and is molded into a shape having a single cavity or plural cavities in the inner portion while having a maximum thickness of 6 mm or less at the surface portion side. The molded powder body is sintered to form into the porous metal structure body having a porosity of 20 to 50% by volume at the portions except the cavities. It is preferable that the metallic powder sintered body having a porosity of exceeding 50% by volume is formed into the cavities by being monolithically integrated with the porous metal structure body. Consequently, a structure being lightweight, having a high mechanical strength and being excellent in handling performance while being excellent in impregnability can be obtained.

3 Claims, 5 Drawing Sheets

A-A ALLOW VIEW

POROUS METAL STRUCTURE BODY AND METHOD FOR MANUFACTURING THE SAME

BACKGROUND OF THE INVENTION

1. Field of the Invention

The invention relates to a porous metal structure body suitably used for improving or adjusting characteristics of light metal alloy members such as an aluminum alloy member, and a method for manufacturing the same. In particular, the invention relates to a porous metal structure body for reinforcing bearings of internal combustion engine made by an aluminum alloy, which is enveloped in the bearing by casting and improves properties of the bearing, and a method for manufacturing the porous metal structure body.

2. Related Art Statement

Engines made of an aluminum alloy as one of light metal alloys has been widely employed in recent years for enhancing lightweight and for improving heat release ability of internal combustion engines. However, since the aluminum alloy is inferior to conventional cast iron in its mechanical strength, it has been a problem that the mechanical strength of members becomes insufficient by employing the aluminum alloy to a member exposed to high temperatures.

For example, a crankshaft of the engine is supported by a bearing with interposition of a bearing metal. The bearing comprises a bearing housing which is a member integrally molded with a cylinder block, and a crankshaft bolding member which is a member secured to the bearing housing with a plurality of fixing bolts. However, it is a problem that rigidity of the bearing becomes insufficient at locations immediately under a crankshaft journal where the bearing suffers a large pressure by explosion of a combustion gas, when all the bearings are made of the aluminum alloy. It is also a problem that noise and vibration are increased due to large clearance when the bearing is exposed to a high temperature, when all the bearings are made of the aluminum alloy. This is because, since the aluminum alloy has a larger thermal expansion coefficient than iron base materials, a large difference of the thermal expansion coefficient is caused between the bearing and crankshaft comprising the iron base material.

For solving such problems, Japanese Utility Model Application Laid-Open No. 63-150115 proposes a light metal alloy crankshaft supporting member of an internal combustion engine in which the inside of a member partitioned by the center line of a bolt hole for mounting a cylinder block and a curved crank journal supporting face is reinforced by complexing with a reinforcing fiber, which states that the volume ratio of the reinforcing fiber is preferably 20 to 40% in order to permit the thermal expansion coefficient to be approximately equal to the thermal expansion coefficient of the crankshaft.

Japanese Patent Application Laid-Open No. 60-219436 proposes an engine block in which the bearing of an aluminum alloy housing cap attached to the lower part of the main unit of an aluminum alloy cylinder block is formed by enveloping an iron base material by casting.

According to the technologies described in Japanese Utility Model Application Laid-Open No. 63-150115 and Japanese Patent Application Laid-Open No. 60-219436, the bearing is able to acquire an increase of mechanical strength that cannot be attained by the aluminum alloy only. The publications also state that rigidity of the bearing is largely improved and a proper clearance is maintained.

Japanese Patent Application Laid-Open No. 2000-337348 proposes a crankshaft bearing having a supporting structure for supporting the crankshaft of the internal combustion engine and a holding part for holding the supporting structure, wherein the material of the supporting structure is a porous material comprising a high silicon aluminum alloy having an approximately equal thermal expansion coefficient to that of the crankshaft material, and the material of the holding part is flowed into voids of the supporting structure.

Japanese Patent Application Laid-Open No. 2001-276961 describes a preliminary molded body of a porous metal comprising a base material of iron or iron base metal containing 10 to 40% by weight of chromium. The preliminary molded body of the porous metal is intended to form a metal composite member by a casting method in which a time lag is given between completing pouring of the molten alloy and impregnation of a molten alloy.

However, in the art disclosed in Japanese Utility Model Application Laid-Open No. 63-150115, it is a problem that the member which is the fiber reinforced composite, does not always have satisfactory characteristics under a high temperature environment. It is difficult by the art disclosed in Japanese Patent Application Laid-Open No. 60-219436 to select iron base materials for controlling the thermal expansion coefficient of the bearing to a desired value, and there is a limitation to decrease the thermal expansion coefficient. Furthermore, the bonding strength of the iron base materials to the aluminum alloy is insufficient.

Although the thermal expansion coefficient difference between the crankshaft and supporting structure is certainly decreased in the art described in Japanese Patent Application Laid-Open No. 2000-337348, the decrease is limited, and stable and satisfactory characteristics cannot be always obtained due to scattering strength at the boundary between the supporting portion and supporting structure.

Decrease of the thermal expansion coefficient is also limited in the composite member obtained by using the porous metal molded body and impregnating it with the aluminum alloy disclosed in Japanese Patent Application Laid-Open No. 2001-276961. The composite material may be exfoliated at the boundary due to scattering the strength of the boundary, thereby often failing in obtaining stable and satisfactory characteristics.

Since the porous metal molded body, or porous metal sintered body has a low strength, its handling is usually difficult. In particular, the porous metal molded body or porous metal sintered body having a low density is readily cracked to make it difficult to subject it to additional molding. In addition, a prescribed shape cannot be often obtained due to generation of exfoliation and cracks, when the porous metal molded body is formed into a composite material by, for example, being enveloping in a light metal alloy member by casting.

SUMMARY OF THE INVENTION

In a first aspect, the invention provides a porous metal structure body formed by molding a mixed powder containing a metallic powder into a prescribed shape followed by sintering. The prescribed shape has a single cavity or dispersed plural cavities in the inner portion, and has a maximum thickness of 6 mm or less at the surface portion side thereof, and the portion other than the cavities has a porosity of 20 to 50% by volume.

Preferably, a metallic powder sintered body having a porosity of more than 50% by volume is formed in the cavity by being monolithically integrated with the porous metal structure body.

The light metal alloy member comprises the porous metal structure body enveloped therein by casting.

In a second aspect, the invention provides a method for manufacturing a porous metal structure body by filling a mixed powder containing a metallic powder into a mold to mold into a prescribed shape followed by sintering. The prescribed shape has a single cavity or dispersed plural cavities in the inner portion, and has a maximum thickness of 6 mm or less at the surface portion side thereof. The porous metal structure body is molded and sintered so that the portion other than the cavities has a porosity of 20 to 50% by volume.

Preferably, the mixed powder containing the metallic powder is filled in the cavities after molding and before sintering, or further compressed at a low pressure after filling the cavities with the mixed powder, so that the cavities are filled with the metallic powder sintered body having a porosity of more than 50% by volume after sintering.

Preferably, the metallic powder molded body or the metallic powder sintered body having a shape capable of fitting the cavity is inserted into the cavities after molding and before sintering, so that the cavities are filled with the metallic powder sintered body having a porosity of more than 50% by volume after sintering.

DETAILED DESCRIPTION OF THE PREFERRED EMBODIMENTS

Accordingly, it is an object of the present invention for solving the technical problems in the conventional art to provide a porous metal structure body suitable for reinforcing a light metal alloy member such as an aluminum alloy member. The porous metal structure body is lightweight, has high strength, is excellent in handling, has excellent impregnability with a light metal alloy such as an aluminum alloy, and is easy for adjusting the thermal expansion coefficient close to the thermal expansion coefficient of iron base metals.

The present inventors found that, through intensive studies for attaining the objects as described above, a single cavity or dispersed plural cavities may be formed at the inner portion to obtain a porous metal structure body being lightweight, having a high strength and being excellent in handling while having excellent impregnability. It was also found that the portion other than the cavities, particularly a surface portion thereof, is formed into a sintered body having a low porosity of 50% or less by volume, and is formed into a shape having a maximum thickness of 6 mm or less at the surface portion side. The sintered body having a porosity of more than 50% by volume is preferably formed to be monolithically integrated with the porous metal structure body in the cavity of the inner portion from the view point of the mechanical strength, impregnability and thermal expansion coefficient.

The present invention was completed based on the discoveries above and further studies.

Figure 3A:
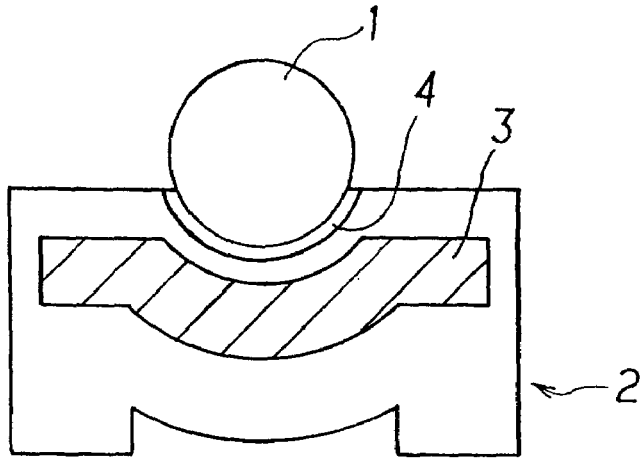
FIGS. 3A and 3B are schematic cross sections showing examples of the internal combustion engine bearing reinforced with the porous metal structure body.
Figure 3B:
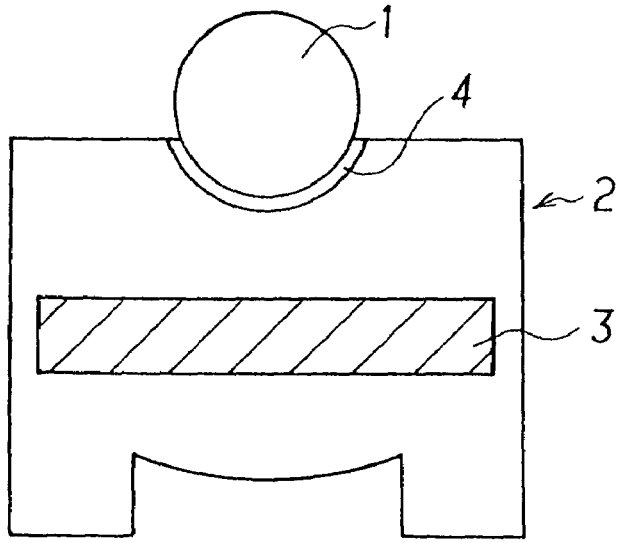

The porous metal structure body of the present invention is useful to reinforce a light metal alloy member by being enveloped by casting in the light metal alloy member such as an internal combustion engine bearing made of an aluminum alloy. For example, the porous metal structure is enveloped within the bearing by casting as shown in FIG. 3A or 3B. In FIGS. 3A and 3B, the reference numeral 1 denotes a crank shaft, the reference numeral 2 denote a bearing, the reference numeral 3 denotes the porous metal structure body, and the reference numeral 4 denotes a bearing metal.

The porous metal structure body of the present invention is a sintered body prepared by filling a metallic powder, preferably a mixed powder containing an iron powder, iron based alloy powder, alloy element powder and/or fine powder particles for improving machinability into a mold to mold into a prescribed shape followed by sintering. The prescribed shape according to the present invention comprises a single cavity or dispersed plural cavities formed in the inner portion, and has a maximum thickness of 6 mm at the surface portion side. The shapes suitable in the present invention are shown in FIGS. 1A to 1C, and in FIGS. 2A and 2B.

Figure 1A:
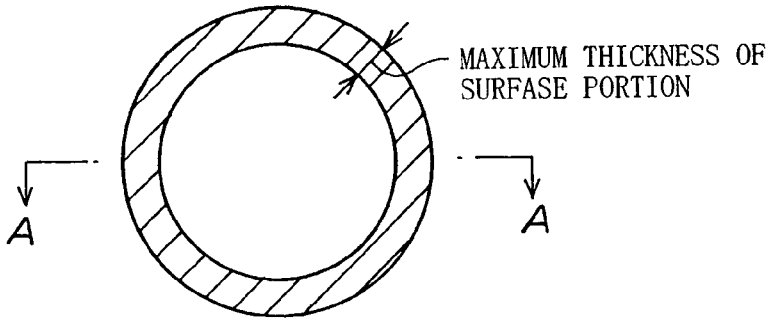
FIGS. 1A to 1C are schematic cross sections showing an example of the shapes of the porous metal structure body of the present invention.
Figure 1A:
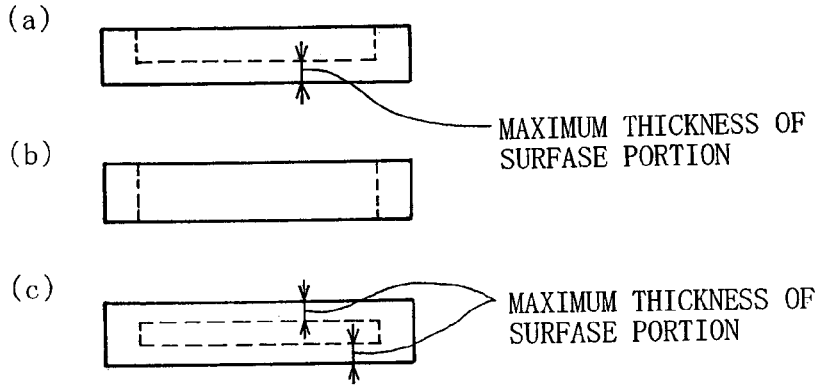
Figure 1B:
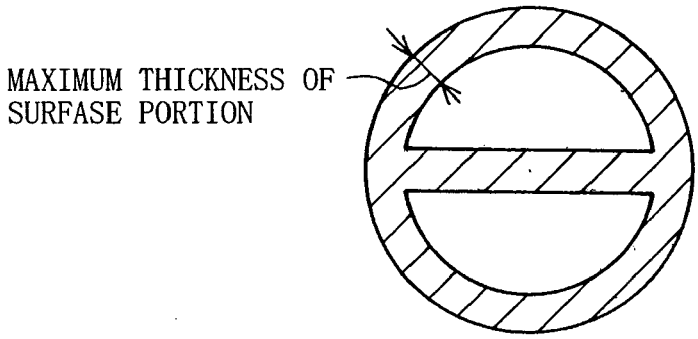
Figure 1C:
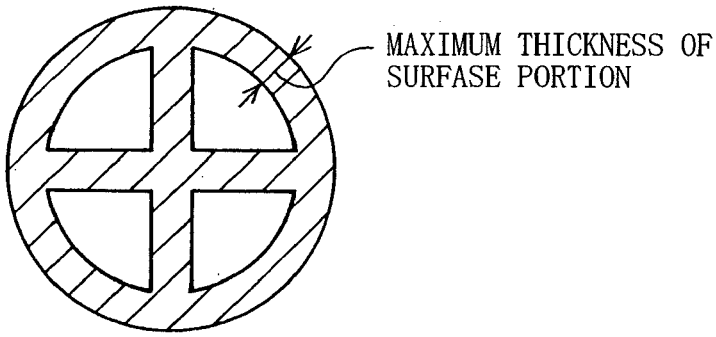

FIGS. 1A to 1C are examples (cross sections) of columnar members having cavities at the inner portion. The member has a single cavity, that is one cavity, as shown in FIG. 1A, plural semicircular small cavities, that is two cavities, as shown in FIG. 1B, and plural quarter-circle cavities, that is four cavities, as shown in FIG. 1C formed at the inner portion.

Bottom setting type cavity as shown in FIG. 1A (a), through-type cavity as shown in FIG. 1A (b), hollow-type cavity as shown in FIG. 1A (c) are also available as the cavity formed at the inner portion. FIG. 1A (a), (b), (c) are examples of A—A allow view of FIG. 1A.

Figure 2A:
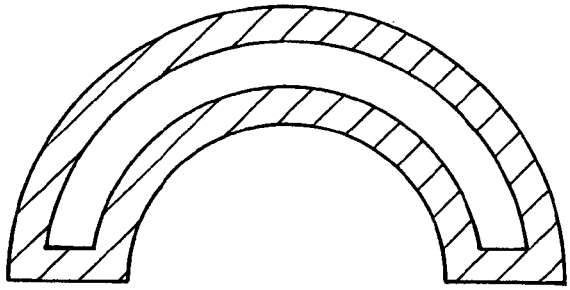
FIGS. 2A and 2B are schematic cross sections showing an example of the shapes of the porous metal structure body of the present invention.
Figure 2B:
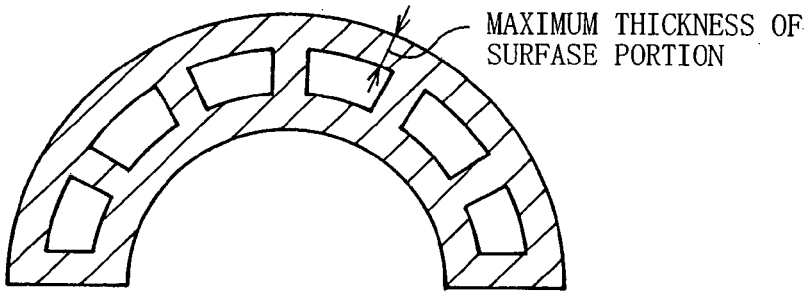

These types of cavity are also available as a type of the cavity as shown in FIGS. 1B, 1C and as a type of the cavities as shown in FIGS. 2A and 2B.

FIGS. 2A and 2B show examples of reinforcing members for reinforcing the bearing by being enveloped by casting in the internal combustion engine bearing made of an aluminum alloy. A single cavity is formed at the inner portion, that is center, in the example in FIG. 2A, while plural fan-shaped small cavities, that is six cavities, are formed in the example in FIG. 2B.

However, the invention is by no means restricted to the examples shown in FIGS. 1A to 1C and FIGS. 2A, 2B.

Forming the cavities at the inner portion, for example, at central part, permits the weight of the porous metal structure body to be reduced contributing for making the structure light-weighed while enabling an effect for improving impregnability to be expected. It is more preferable to form dispersed plural cavities, that is small cavities, in the inner portion than forming a large single cavity, from the view point of improving the mechanical strength of the porous metal structure body with the proviso that the total volumes of the cavities are identical in both cases. The shape of the cavity is not required to be particularly restricted, not to say that the shape is restricted to a circle. The size of the cavity is also not particularly restricted, so long as a mold corresponding to the cavity is readily formed.

The porous metal structure body of the present invention has the cavities in the inner portion, and has a prescribed thickness at the surface portion side. The maximum thickness at the surface portion side is 6 mm or less in the present invention. Forming the surface portion side with the maximum thickness of 6 mm or less permits the structure to stably maintain a high mechanical strength to improve handling performance. When the maximum thickness of the surface portion side exceeds 6 mm, on the other hand, impregnability decreases in the porosity range of the present invention to cause insufficient impregnation of a molten alloy such as a molten aluminum alloy from the surface, thereby decreasing the bonding strength between the alloy and the porous structure body enveloped in the alloy by casting. The minimum thickness of the surface layer side is determined by the material and size of the porous metal structure body, so that the porous metal structure body has a mechanical strength to an extent not broken during handling. The relation between the thickness capable of impregnation of aluminum and the porosity of the porous metal sintered body is shown in FIG. 4.

The portions except the cavities of the porous metal structure body of the present invention is formed into a sintered body having a porosity of 20 to 50% by volume. The mechanical strength of the porous metal structure body decreases when the porosity of the portions except the cavities, or the porosity of the layer formed at least at the surface portion side, exceeds 50%, thereby decreasing compactibility and handling performance. Furthermore, cracks and exfoliation are generated by complexing such as enveloping by casting when the porosity of the portions except the cavities exceeds 50% by volume, thereby making it difficult to form into a desired shape.

Figure 4:
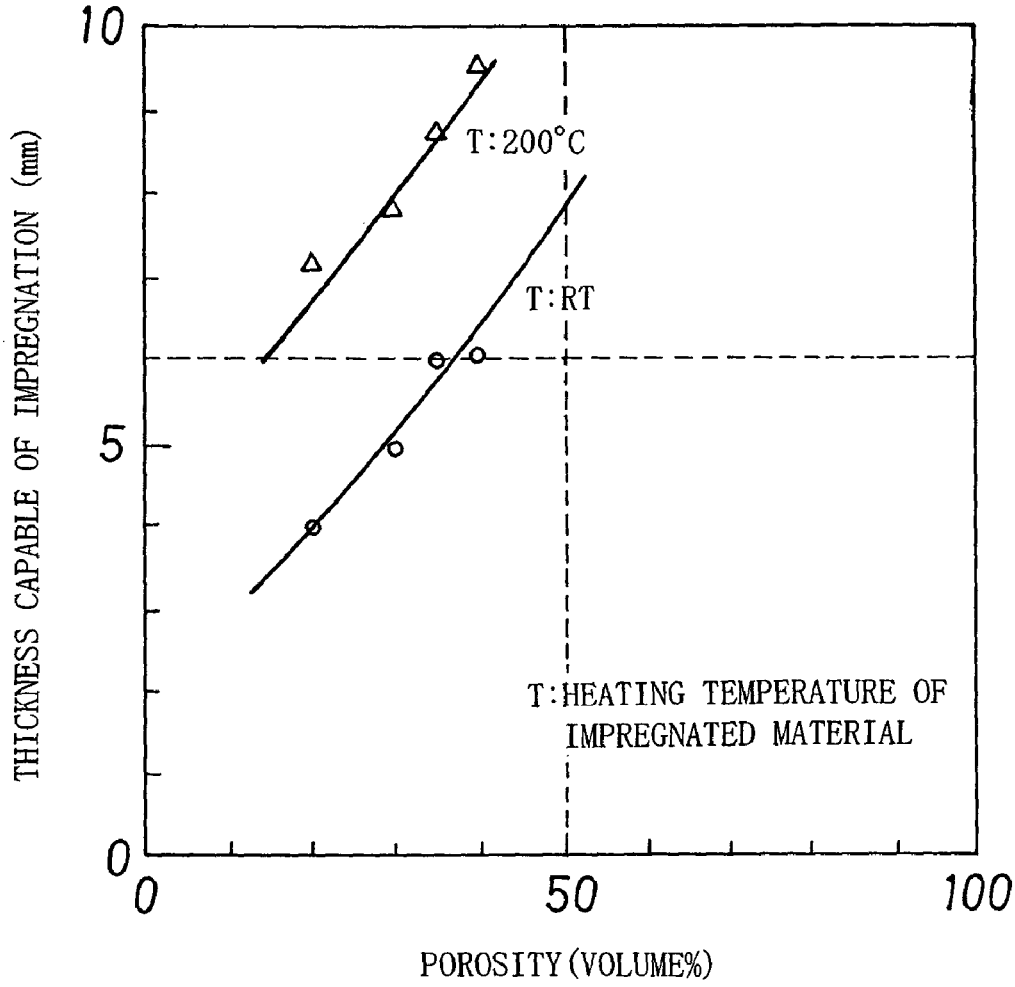
FIG. 4 is a graph showing the relation between the thickness capable of impregnation of a molten aluminum alloy and porosity of the porous metal structure body.

When the porosity of the portions except the cavities is less than 20% by volume, on the other hand, impregnability decreases as shown in FIG. 4, although the mechanical strength of the porous metal structure body is improved. Accordingly, the lower limit of the porosity of the portions except the cavities was determined to be 20% by volume.

Although the cavities formed in the inner portion may remain vacant, it is preferable in the present invention that a metallic powder sintered body having a porosity of exceeding 50% by volume is monolithically integrated with the porous metal structure body as the main body. Integrating, or filling, the metallic powder sintered body in the cavities as described above permits adjustable ranges of the thermal expansion coefficient of the porous metal structure body to be expanded. When the porous metal structure body reinforces the bearing by, for example, being enveloped by casting in the bearing of the internal combustion engine made of an aluminum alloy, it is possible to permit the thermal expansion coefficient of the bearing to come close to the thermal expansion coefficient of the shaft which is made of an iron based metal by adjusting the amount of blending of the metallic powder in the metallic sintered body formed in the cavities of the porous metal structure body. Impregnability is also improved by forming or filling the metallic powder sintered body in the cavities as described above, thereby improving the bonding strength between the bearing and porous metal structure body enveloped in the aluminum alloy by casting.

Impregnability is remarkably decreased when the porosity of the metallic powder sintered body formed or filled in the cavities is 50% or less by volume, although the thermal expansion coefficient may be more readily adjusted. The porosity of the metallic powder sintered body formed, or filled, in the cavities is preferably 60% or more by volume.

The method for manufacturing the porous metal structure body of the present invention will be described hereinafter.

A mixed powder containing the metallic powder is filled in a mold, and the powder is press-molded with a press into a prescribed shape having the cavities in the inner portion with a maximum thickness of the layer of 6 mm or less at the surface portion side, thereby forming a green compact.

The mixed powder used preferably comprises a metallic powder such as an iron powder, iron based alloy powder or an alloy element powder to which a graphite powder, lubricant powder and fine particles of a solid lubricant powder for improving machinability, if necessary, are blending. However, the mixed powders is not restricted thereto.

It is preferable to add the lubricant powder in the mixed powder in order to improve compactibility during compression molding of the powder while increasing the density of the green compact. Preferable examples of the lubricant powder include a powder of zinc stearate. Examples of the fine particle powder for improving machinability include powders of MnS, $CaF_2$, BN and enstatite. While the method for preparing the mixed powder is not particularly restricted, using a V-mill is economically preferable.

The molding pressure is preferably adjusted so that the porosity of the portions except the cavities is 20 to 50% by volume.

The green compact is converted into a sintered body by applying a sintering treatment. The sintering conditions are preferably adjusted so that that the porosity of the portions except the cavities is 20 to 50% by volume.

Preferably, the mixed powder containing the metallic powder is sintered after molding by filling it in the cavities formed in the inner portion, or after additional compression at a low pressure. Consequently, the metallic powder sintered body is molded or filled in the cavities by being monolithically integrated with the portions except the cavities. It is preferable that the mixed powder containing the metallic powder is filled, or further compressed at a low pressure, if necessary, so that the sintered body formed in the cavities has a porosity of exceeding 50% by volume. Impregnability may be decreased at a porosity of 50% or less by volume after sintering. The preferable porosity is 60 to 65% by volume. The mixed powder containing the metallic powder to be filled in the cavities may comprise the same kind of the substances as the portions except the cavities, or the substances may be different with each other.

The compressed metallic powder body having a shape capable of fitting the cavities, or the metallic powder sintered body having a shape capable of fitting the cavities may be sintered by inserting into the cavities after molding and before sintering. The metallic powder sintered body may be also formed or filled by being monolithically integrated with the portions except the cavities by the process as described above. The compressed metallic powder body or the metallic powder sintered body formed into a shape capable of fitting the cavities are preferably adjusted to have a porosity of exceeding 50% by volume after sintering.

The porous metal structure body prepared by the manufacturing method as described above is mounted onto the corresponding portion of the casting mold for forming the light metal alloy member, for example the bearing of the internal combustion engine as shown in FIG. 3. Subsequently, a molten alloy of the light metal alloy, for example an aluminum alloy, is injected into the casting mold, followed by high pressure die casting or liquid-forging to manufacture the light metal alloy member, for example internal combustion engine bearing, in which the sintered body is enveloped by casting. Consequently, bonding to the light metal alloy member is completed by allowing the molten alloy to impregnate into the voids of the porous metal structure body. The light metal alloy member is processed into an article having a prescribed shape by applying a cutting work. The porous metal structure body is preferably pre-heated to the temperature higher than room temperature before being enveloped in the aluminum alloy member by casting. The thickness capable of impregnation of the molten alloy increases as shown in FIG. 4 by pre-heating the porous metal structure body enveloped in the aluminum alloy by casting to the temperature higher than room temperature, thereby improving impregnability.

EXAMPLES

A mixed powder was prepared by adding, followed by kneading, a graphite powder and lubricant powder, and a MnS powder as machinability improving fine particles, if necessary, to a metallic powder comprising a Fe—Cr alloy powder (Cr: 12% by mass), an iron powder and a Cr powder, and an alloy element powders, if necessary. Then, the mixed powder was filled in a mold followed by press-molding with a molding press, thereby forming a compressed powder body with a prescribed shape having cavities in the inner portion. The prescribed shape having the cavities which are through-type in the inner portion was as shown in FIGS. 1A to 1C. The Fe—Cr alloy powder, iron powder and Cr powder, and the alloy element powder if necessary, were blended so that the contents of Cr, C and the alloy elements other than Cr and C of the sintered body become as shown in Table 1. The compressed powder body had a dimension of 50 mm (outer diameter)×15 mm (thickness).

Subsequently, the compressed powder body was sintered at 1100 to 1250° C. to prepare the porous metal structure body having a porosity at the portions except the cavities as shown in Table 1. A part of the structure bodies, which is sintered bodies, were processed to have a prescribed thickness by electric discharge machining followed by removing moisture and oily components in a drying furnace. Test pieces were sampled from the portions except the cavities, and the density was measured according to Archimedean principle to convert the density into the porosity.

A mixed powder blended so that the contents of Cr, C and alloy elements other than Cr and C of the sintered body become as shown in Table 1 was filled in the cavities of the inner portion with respect to a part of the compressed powder bodies, and the compressed powder bodies were sintered under the same condition as described above after compressing at a low pressure. Consequently, the sintered bodies having the porosity as shown in Table 1 were formed in the cavities to form the porous metal structures bodies monolithically integrated with the portions except the cavities. After the portions except the cavities were removed by machining, the porosity of the sintered body formed in the cavity was determined by converting the density thereof measured according to Archimedean principle into the porosity.

The porous metal structure body obtained was dropped from the height of 20 cm to evaluate handling performance by observing the presence of cracks and exfoliation, if any, by naked eyes.

The porous metal structure body thus obtained was mounted on the prescribed position of the casting mold corresponding to the internal combustion engine bearing. Subsequently, an molten aluminum alloy (JIS ADC12) was injected by high pressure die-casting to form a member corresponding to the internal combustion engine bearing having a prescribed dimension (22 mm in thickness×110 mm in width).

A tensile test piece including the boundary to the porous metal structure body was sampled from the member corresponding to the internal combustion engine bearing for measuring the tensile strength thereof. The sampling direction of the tensile test piece was perpendicular to the test piece axis including the boundary face. The tensile strength $\sigma$ was evaluated as a ratio to a desired boundary strength $\sigma_E$, or as a strength ratio $\sigma/\sigma_E$. $\sigma_E$ as used herein denotes a boundary strength of cast iron plated with aluminum and enveloped in an aluminum alloy by casting.

Test pieces were sampled from the portions except the cavities and from cavity portions, respectively, of the members corresponding to the internal combustion engine bearing, and the thermal expansion coefficient, which is a mean value between room temperature and 200° C., of each test piece was measured with a thermal expansion coefficient measuring apparatus. The mean thermal expansion coefficient of the entire member corresponding to the bearing was calculated from the volume ratio of each portion. When no sintered body is formed in the cavity, the test piece sampled from the cavity member comprises only the aluminum alloy.

The results obtained are shown in Table 1.

All the examples of the invention is excellent in handling performance with no defects, and have a strength ratio of as high as 1.0 or more. Each alloy member in the examples of the invention in which a porous metal sintered body having a porosity of exceeding 50% by volume is formed, or filled in the cavity has a thermal expansion coefficient close to the thermal expansion coefficient of alloy based materials.

On the other hand, the alloy members in the comparative examples out of the range of the invention has a lower strength ratio or larger thermal expansion coefficient. Accordingly, the alloy member in the comparative has so large clearance when it is used as the internal combustion engine bearing that it has a potential danger of generating noises and vibration when it is used as the internal combustion engine bearing.

The present invention provides a method for stably and readily manufacturing a porous metal structure body being lightweight, excellent in handling performance, and excellent in impregnability of light metal alloys such as an aluminum alloy, as well as being ready for adjusting the thermal expansion coefficient to be close to the thermal expansion coefficient of iron based metals. Accordingly, the present invention is quite effective for industrial applications.

TABLE 1

| Example No. | Prescribed shape | Structure: Portion except cavity: Content (% by mass) Cr | C | Others | Fe | Porosity (% by vol) | Maximum thickness of surface portion side mm | Cavity portion: Content (% by mass) Cr | C | Others | Fe | porosity (% by vol) |
|---|---|---|---|---|---|---|---|---|---|---|---|---|
| 1 | FIG. 1A | 12.0 | 0.3 | 1.0 or less | bal. | 22 | 5 | 55.0 | 2.0 | 2.0 | Bal. | 62 |
| 2 | FIG. 1A | 12.0 | 0.3 | 1.0 or less | bal. | 22 | 5 | 55.0 | 2.0 | 2.0 | Bal. | 51 |
| 3 | FIG. 1A | 12.0 | 0.3 | 1.0 or less | bal. | 22 | 5 | — | — | — | — | — |
| 4 | FIG. 1B | 12.0 | 0.3 | 1.0 or less | bal. | 22 | 5 | 55.0 | 2.0 | 2.0 | Bal. | 62 |
| 5 | FIG. 1B | 12.0 | 0.3 | 1.0 or less | bal. | 22 | 5 | — | — | — | — | — |
| 6 | FIG. 1C | 12.0 | 0.3 | 1.0 or less | bal. | 22 | 5 | 55.0 | 2.0 | 2.0 | Bal. | 62 |
| 7 | FIG. 1C | 12.0 | 0.3 | 1.0 or less | bal. | 22 | 5 | — | — | — | — | — |
| 8 | FIG. 1A | 12.0 | 0.3 | 1.0 or less | bal. | 47 | 5 | 55.0 | 2.0 | 2.0 | Bal. | 62 |
| 9 | FIG. 1A | 30.0 | 2.0 | 1.0 or less | bal. | 23 | 5 | 55.0 | 2.0 | 2.0 | Bal. | 62 |
| 10 | FIG. 1A | 30.0 | 2.0 | 1.0 or less | bal. | 23 | 5 | 45.0 | 2.5 | 2.0 | Bal. | 61 |
| 11 | FIG. 1A | 12.0 | 0.3 | 1.0 or less | bal. | 53 | 5 | 55.0 | 2.0 | 2.0 | Bal. | 62 |
| 12 | FIG. 1A | 12.0 | 0.3 | 1.0 or less | bal. | 48 | 6.5 | 55.0 | 2.0 | 2.0 | Bal. | 62 |
| 13 | FIG. 1A | 12.0 | 0.3 | 1.0 or less | bal. | 48 | 5 | 55.0 | 2.0 | 2.0 | Bal. | 48 |

| Example No. | Handling performance | Characteristics after enveloping by casting: Tensile prosity Strength ratio* | Thermal expansion coefficient × $10^{-6}$ $k^{-1}$ | Note |
|---|---|---|---|---|
| 1 | Good | 1.3 | 14.7 | Example of the invention |
| 2 | Good | 1.2 | 13.6 | Example of the invention |
| 3 | Good | 1.3 | 17.4 | Example of the invention |
| 4 | Good | 1.3 | 14.1 | Example of the invention |
| 5 | Good | 1.3 | 16.8 | Example of the invention |
| 6 | Good | 1.3 | 12.9 | Example of the invention |
| 7 | Good | 1.3 | 15.1 | Example of the invention |
| 8 | Good | 1.4 | 14.4 | Example of the invention |
| 9 | Good | 1.2 | 13.5 | Example of the invention |
| 10 | Good | 1.1 | 14.6 | Example of the invention |
| 11 | Poor | — | — | Comparative example |
| 12 | Good | 0.9 | — | Comparative example |
| 13 | Good | 0.8 | — | Comparative example |

*Strength ratio = $\sigma/\sigma_E$, $\sigma_E$: bonding strength of cast iron plated with aluminum

What is claimed is:

1. A porous metal structure body which is enveloped in a cast light metal alloy member, wherein the cast light metal alloy member is a bearing portion of an internal combustion engine and wherein the porous metal structure body reinforces the bearing portion, formed by molding a mixed powder containing a metallic powder into a prescribed shape followed by sintering, which comprises the prescribed shape having a single cavity or dispersed plural cavities in an inner portion with a maximum thickness of 6 mm or less at a surface portion side thereof, and a portion other than the cavities having a porosity of 20 to 50% by volume.

2. The porous metal structure body according to claim 1, wherein the metallic powder sintered body having a porosity of more than 50% by volume is formed in the cavity by being monolithically integrated with the porous metal structure body.

3. A light metal alloy member, wherein the light metal alloy member is a bearing portion of an internal combustion engine, comprising a porous metal structure body enveloped in the light metal alloy by casting and reinforcing the bearing portion, said porous metal structure body being formed by molding a mixed powder containing a metallic powder into a prescribed shape followed by sintering, which comprises the prescribed shape having a single cavity or dispersed plural cavities in an inner portion with a maximum thickness of 6 mm or less at a surface portion side thereof, and a portion other than the cavities having a porosity of 20 to 50% by volume.

* * * * *